30-308 SR

10/22/85 XR 4,548,248

United States Patent [19]

Riemann

[11] Patent Number: 4,548,248

[45] Date of Patent: Oct. 22, 1985

[54] HANDLE FOR STRIKING TOOL

[76] Inventor: Herbert F. Riemann, 182 Guinea Rd., Stamford, Conn. 06903

[21] Appl. No.: 583,865

[22] Filed: Feb. 27, 1984

[51] Int. Cl.[4] ..... B25G 1/00

[52] U.S. Cl. ..... 81/22; 81/19; 81/20; 30/308.1

[58] Field of Search ..... 145/61 C, 29 R, 36, 145/61 R

[56] References Cited

U.S. PATENT DOCUMENTS

D. 19,522 12/1889 Davis ..... 145/61 C
375,773 1/1888 Rockwell ..... 145/61 C
412,479 10/1889 Davis ..... 145/61 C
2,808,861 10/1957 Hughes ..... 145/36
3,543,715 12/1970 Hill ..... 145/29 R

*Primary Examiner*—Frederick R. Schmidt
*Assistant Examiner*—J. T. Zatarga
*Attorney, Agent, or Firm*—Natter & Natter

[57] ABSTRACT

A handle for a striking tool includes a hand-fitting elongate body adapted for supporting an impact head at one end. The handle body is provided with transverse finger receiving recesses, complementary grooves within opposed side faces and a longitudinal thumb receiving channel. In addition, an angular tail extension provides a palm and finger grip. The interaction of the user's hand and fingers at alternate locations along the handle body provide for selected power strokes using an arcuate motion about a finger pivotal point.

9 Claims, 6 Drawing Figures

FIG. 1
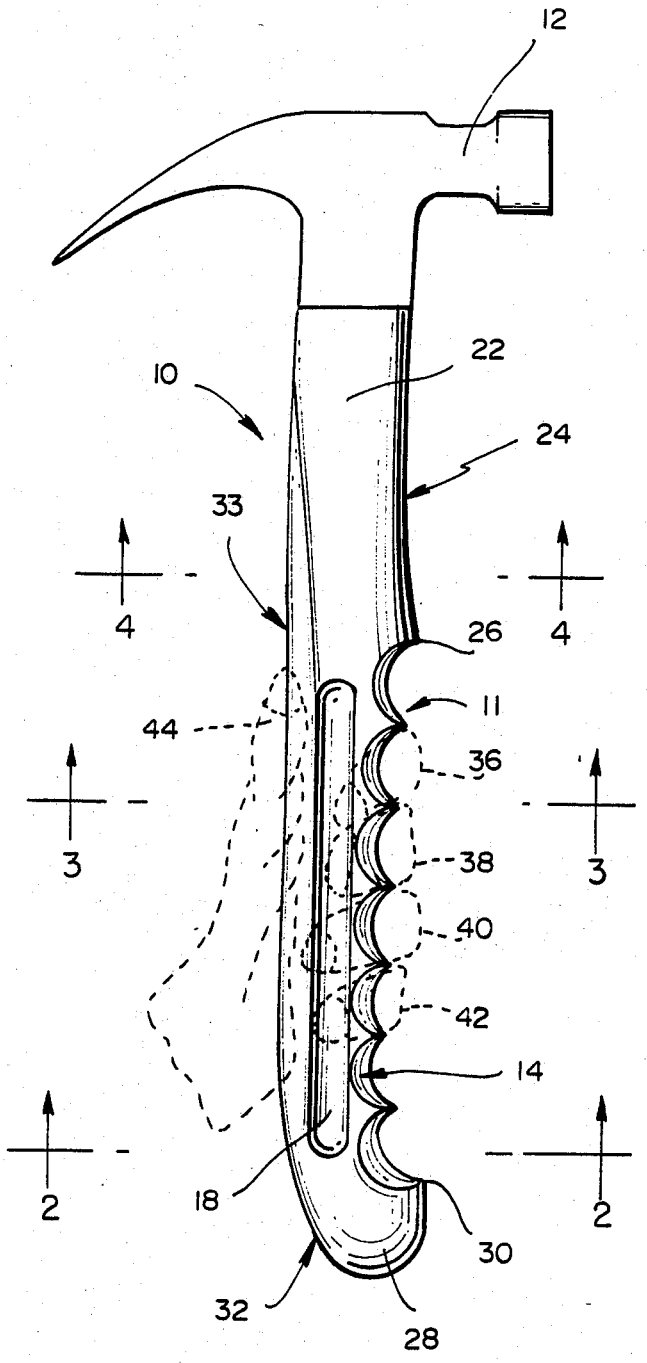
FIG. 2
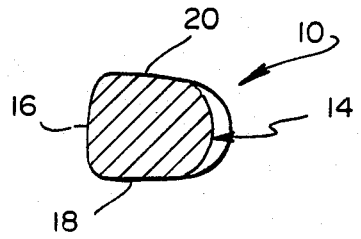
FIG. 3
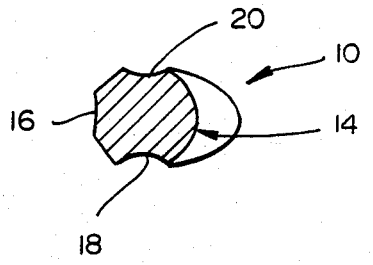
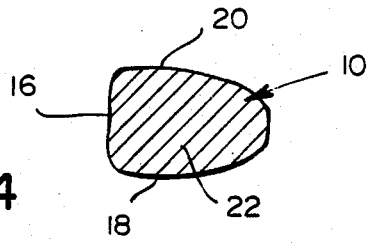
FIG. 4

HANDLE FOR STRIKING TOOL

TECHNICAL FIELD

This invention relates to hand tools and especially to a handle for a striking tool.

In particular, this invention concerns a multi-position hand grip for delivering controlled wrist-action power strokes.

BACKGROUND ART

Conventional hand tools, such as hammers, hatchets, and similar swingable implements, were typically provided with a linear shaft for providing mechanical advantage. Those handles relied primarily upon a frictional hand gripping action with the hand being held between defined boundaries for optimum performance. In addition, the previously available handles that were intended for impact driving required a tight-fisted grip with the handle being swung in an arcuate motion about the user's wrist.

A problem with those tool handle designs was that it was difficult to control movement of the tool head with accuracy and precision during the power stroke. This could be compensated for by using differently shaped and weighted tool heads to customize the tools for the particular applications.

A further disadvantage of the prior tool handle arrangements was that the firmness of the gripping action was primarily a factor of the compressive forces applied through the muscular hand-grip of the user. It should also be apparent that the shock effect upon impact was transmitted through the hand, arm and body of the user and furthermore, that the hand grip could be subject to slippage during use.

Another shortcoming of the aforementioned handle designs was that the free end of the handle could not be utilized as an alternate power grip or as a fulcrum for delivering a pendulum motion driving force.

A further deficiency of the aforementioned tool handles was that, under actual field conditions as when using the hand tool within close proximity to a working surface, the user's fingers frequently projected beyond the periphery of the handle margin and this often resulted in "skinned" knuckles.

Previous attempts to modify tool handles included the incorporation of finger recesses, as were shown in U.S. Pat. Nos. 2,076,836, 2,124,615 and 2,205,769 and in U.S. Pat. Nos. Des. 139,475, Des. 157,883 and Des. 185,675. Those patents, however, did not present a handle body with finger interaction for generating a power stroke using pivotal action about a selected finger.

The instant invention overcomes many of the problems, disadvantages and drawbacks of the prior art and provides a handfitting handle body adapted for driving an impact head and for achieving increased accuracy and precision, improved directional and power control, and reduced hand slippage.

DISCLOSURE OF THE INVENTION

Briefly, the nature of this invention concerns an improved handle for ansate tools and particularly for swingable tools having an impact head affixed to an end of the handle.

The purpose of this handle is to provide an effective interaction between the handle body and a user's hand and fingers for delivering a driving force using an arm and wrist motion. The handle body is provided with finger recesses within a forward face, complementary grooves within opposed side faces, and a longitudinal channel within a rear face.

A feature of this handle structure is that these contours provide a grip which does not rely primarily upon the coefficient friction of the handle material or the muscular forces generated by the user's hand. The hand grip can consequently be more relaxed and a wrist motion can be used when swinging the handle. This provides an energy saving aspect by increasing the impact head velocity during the arcuate stroke. The relaxed grip also provides a more sensitive "feel" of the tool head. It should also be noted that the wrist action improves upon the versatility of the tool within the limitations of the user's wrist and arm and, for example, facilitates driving the impact head toward overhead objects. Another advantage of the arrangement of the previously described recesses, grooves and channel is that the user's hand can be adjustably positionable, yet firmly secured, along the length of the handle for varying the power stroke. It should be additionally noted that the finger recesses seat the user's fingers below a peripheral margin of the handle and thereby provide clearance when using the tool close to a working surface. The relaxed finger grip is also effective for dissipating the shock effect upon impact.

In addition, an angular tail extension defines a heel member or knob which can be held within a palm pocket formed by the user's hand. This operative grip will provide a maximum length lever for generating an impact force. The heel member can also be used as a pivot and the handle swung about the pivot in the manner of a pendulum.

A portion of the handle adjacent the impact head includes a neck section of increased cross sectional area for structural rigidity and strength.

In view of the foregoing, it should be apparent that the present invention overcomes many of the disadvantages, shortcomings and deficiencies of the prior art and provides a handle for a swingable tool which avoids many of the problems previously encountered.

Having thus summarized the invention, it will be seen that it is an object thereof to provide a handle for a striking tool of the general character described herein which is not subject to the aforementioned shortcomings.

Specifically, it is an object of this invention to provide an improved handle for delivering a selectively variable power stroke for a swingable striking tool.

Another object of the present invention is to provide a handle adapted for securing an impact head at one end and including a heel at a distal end for palm gripping.

Yet another object of this invention is to provide a handle for a striking tool having finger contours for providing a relaxed hand grip using a pivotal movement about a finger.

A still further object of this invention is to provide a handle for a striking tool that is simple in construction, low in cost, reliable in use and well adapted for mass production fabrication techniques.

Other objects, features, and advantages of the invention will in part be obvious and will in part be pointed out hereinafter.

With these ends in view, the invention finds embodiments in certain combinations of elements and arrangements of parts by which the objects aforementioned and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown possible exemplary embodiments of the invention:

FIG. 1 is an elevational view of the swingable handle of this invention showing the handle being used in a substantially vertical orientation with the user's hand proximate a neck portion of the handle;

FIG. 2 is a sectional view taken substantially along line 2—2 of FIG. 1;

FIG. 3 is a sectional view taken substantially along line 3—3 of FIG. 1 showing a lateral side groove in complementary side faces and a longitudinal thumb engageable channel in a rearward face;

FIG. 4 is a sectional view taken substantially along line 4—4 of FIG. 1;

BEST MODE FOR CARRYING OUT THE INVENTION

Figure 5:
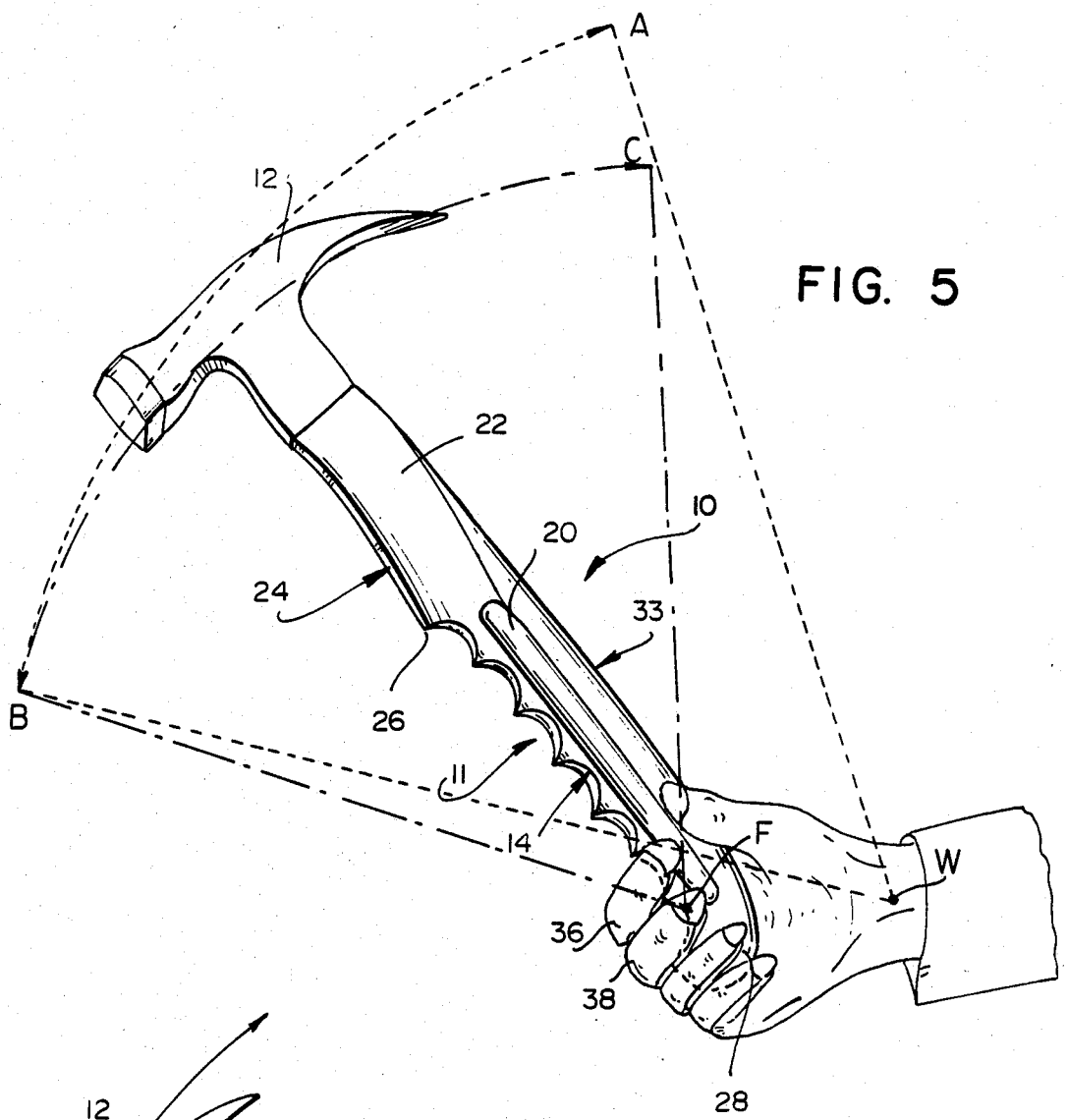
FIG. 5 is a perspective view to a slightly reduced scale of the handle illustrating a palm pocket grip utilizing a heel member for maximizing the power stroke and the pivotal swing.

Referring now in detail to the drawings, the reference numeral 10 denotes generally a handle for a striking tool in accordance with this invention. For the purpose of this exemplary embodiment, the handle 10 is illustrated supporting a hammer head 12 affixed at one end. The handle 10 is adaptable for use with other impact heads such as found on an ax, hatchet, mallet, and similar hand tools which utilize a swinging movement for generating an impact force.

By way of example, the handle 10 can be formed from ash stock and provided with a 16 oz. (0.5 kilograms) steel hammer head 12. The overall length of the handle is about 12½ in. (or 32 cms.) and the maximum width dimension is 1¾ in. (or 4½ cms.). The maximum thickness dimension is 1⅛ in. (or 2.8 cms.).

Referring once again to the handle 10, it should be noted that a forward face 11 is provided with a plurality of contiguous semi-circular finger recesses 14 and that a rearward face 33 of the handle 10 includes a thumb engageable channel 16. The opposite side faces of the handle 10 include shallow grooves 18, 20. In addition, a neck portion 22 at an upper end of the handle 10 adjacent the hammer head 12 has an obliquely extending front face 24 being co-terminous with an upper finger recess limit 26. In this preferred embodiment, seven finger recesses 14 have been shown.

The distal end of the handle 10 is provided with an angular tail extension forming a heel member 28. The projection of the heel defines a lower finger recess limit 30 of the forward face 11 and provides a pivot point as will be later explained. The rearward face of the heel includes an angularly curved segment 32 with which merges with the substantially linear rearward face 33 of the handle 10 extending to the hammer head 12. The maximum cross-sectional area occurs in the neck 22 at the upper finger recess limit 26.

As previously pointed out, the finger recesses 14 are adaptable for substantially accommodating the user's fingers denoted as 36, 38, 40, 42, within a peripheral margin of the handle 10 as drawn by an imaginary line from the upper finger recess limit 26 to the lower finger recess limit 30.

Figure 6:
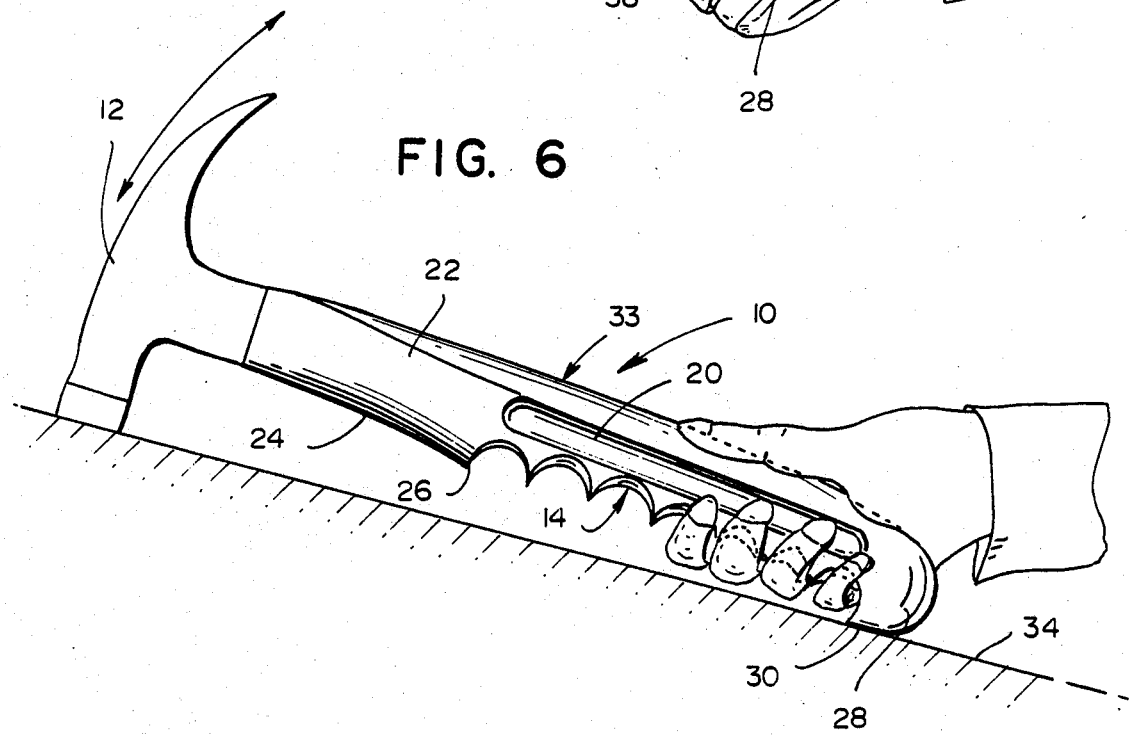
FIG. 6 is a side elevational view illustrating finger clearance as provided by a plurality of contiguous transverse finger accommodating recesses and also demonstrating thumb positioning for maintaining lateral control of the handle while exerting a driving force during an arcuate power stroke.

In connection with FIG. 6, the handle 10 is shown wherein the heel member 28 rests against a fixed surface 34 and serves as a pivot point. The hammer handle 10 is moved in an oscillating or pendulum motion using short strokes as would be required for delicate work or when driving a nail within a confined area. This application illustrates the finger clearance provided by the finger recesses 14 and the utilization of the thumb engageable channel 16 for directing and controlling the swingable movement.

A maximum "free swing" power stroke can be accomplished by securing the heel 28 within a palm pocket of the user's hand and interlocking at least the two fingers 36, 38 within respective finger recesses 14, as shown in FIG. 5.

Intermediate power strokes are achievable when grasping the handle 10 in the manner shown in FIG. 1. It should be noted that the user's four fingers 36, 38, 40, 42 are receivable in respective finger recesses 14 with the fingertips lying within the companion groove 18 or groove 20 if a right-hand grip is used. A thumb 44 lies within thumb engageable channel 16. This grasping action does not rely solely upon a frictional grip but rather utilizes a finger-recessing interlocking in conjunction with thumb and finger control. The loose and relaxed grip permits the wrist to travel more freely when using the tool and provides a more sensitive feel. Also, the pivotal point is shifted from the user's wrist to the fingers and predominantly the middle finger 38 which acts as a fulcrum. This is in contrast to conventional handles which are tightly held and consequently pivotable about the user's wrist.

In FIG. 5, an arc A-B demonstrates the pivotal head movement about a wrist point W as in the prior art. With the selectable finger pivot point of this invention, the head will travel along an arc C-B as when the handle is swung about finger 38 which defines a finger pivotal point F.

In addition, it should be also be pointed out that by incremental hand placement along the handle, variable power stroke settings can readily be achieved. For example, a hand grip which places the middle finger 38 in a recess 14 adjacent the upper finger recess limit 26, will provide a shorter lever arm and a reduced power setting. Conversely, when the middle finger 38 is positioned closer to the lower finger recess limit 30, a more powerful driving stroke is possible.

It should be understood that the pivotal movement described can be achieved about any of the fingers 36, 38, 40, 42 when placed within the recesses 14.

Thus, it will be seen that there is provided a handle for a striking tool which achieves the various objects of the invention and which is well adapted to meet conditions of practical use.

Since various possible embodiments might be made of the present invention or various changes might be made in the exemplary embodiment set forth, it is to be understood that all materials shown and described in the accompanying drawings are to be interpreted as illustrative and not in a limiting sense.

Having thus described the invention, there is claimed as new and designed to be secured by Letters Patent:

1. A handle for a striking tool comprising a hand-fitting elongate body adapted for supporting an impact head at one end, said handle body having a plurality of transverse finger receiving recesses along a forward face, a rearward face defining thumb positioning means including a longitudinal thumb engageable channel, said handle body further having complementary side faces, each of said faces including an elongate fingertip receiving groove extending longitudinally along the length of the handle body at least a distance corresponding to the finger receiving recesses, said thumb engageable channel and fingertip receiving grooves providing for directional thumb and fingertip control of the handle body during swingable movement of the impact head, said handle body further being grippable at alternate locations along the transverse finger receiving recesses for pivotally swingable movement about a selected finger engaged recess to provide variable power settings.

2. A handle body as claimed in claim 1 further including an angular tail extension at a distal end of the handle body providing an alternate palm and finger engageable grip.

3. A handle body as claimed in claim 2 further including a neck portion proximate the impact head, said neck portion providing a maximal cross-sectional area of said handle body.

4. A handle for a striking tool as claimed in claim 2 wherein the tail extension defines a heel member, said heel member defining a lower finger recess limit along the forward face.

5. A handle for a striking tool as claimed in claim 4 wherein the heel member provides a pivot point, with the handle body being swingable about the pivot point for generating an oscillatory driving force.

6. A handle for a striking tool as claimed in claim 4 wherein the rearward face of said heel member includes a curved segment, said segment merging with a linear segment, said linear segment extending to the impact head.

7. A handle for a striking tool as claimed in claim 6 wherein the heel member defines one end of a peripheral margin of the forward face.

8. A handle for a striking tool as claimed in claim 7 wherein the neck portion defines another end of the peripheral margin of the forward face with said transverse finger receiving recesses being disposed between the said heel member and neck portion.

9. A handle for a hand-held striking tool having an impact head secured at one end, said striking tool being adapted for swingable movement of the impact head, the improvement comprising a handle body having finger recess means along a longitudinal length of a forward face of said handle body for providing finger grip engagement at selected locations along the length of said handle body and pivotal movement about a selected finger, thumb positioning means extending longitudinally along the length of a rearward face of said handle body, and fingertip groove means extending longitudinally along each of a side face of said handle body, said thumb positioning means and fingertip groove means providing for improved hand-grip and fingertip directional control of the impact head during swingable movement.

* * * * *